US010063014B2

(12) United States Patent
Wen et al.

(10) Patent No.: US 10,063,014 B2
(45) Date of Patent: Aug. 28, 2018

(54) ELECTRICAL CONNECTOR HAVING GROUNDING TERMINALS SERVING A LATCHING FUNCTION

(71) Applicant: FOXCONN INTERCONNECT TECHNOLOGY LIMITED, Grand Cayman (KY)

(72) Inventors: Wei Wen, Huaian (CN); Jun Zhao, Huaian (CN); Jin-Guo Qiu, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/629,772

(22) Filed: Jun. 22, 2017

(65) Prior Publication Data

US 2017/0373439 A1 Dec. 28, 2017

(30) Foreign Application Priority Data

Jun. 22, 2016 (CN) ..... 2016 1 0452644

(51) Int. Cl.

| | |
|---|---|
| ***H01R 13/6581*** | (2011.01) |
| ***H01R 13/04*** | (2006.01) |
| ***H01R 24/60*** | (2011.01) |
| ***H01R 13/64*** | (2006.01) |

(52) U.S. Cl.

CPC ..... *H01R 13/6581* (2013.01); *H01R 13/04* (2013.01); *H01R 13/64* (2013.01); *H01R 24/60* (2013.01)

(58) Field of Classification Search

CPC .... H01R 13/6581; H01R 13/04; H01R 24/60; H01R 13/64

USPC ..... 439/95

See application file for complete search history.

(56) References Cited

U.S. PATENT DOCUMENTS

| | | | | |
|---|---|---|---|---|
| 8,033,841 | B2 * | 10/2011 | He | H01R 13/6473 439/108 |
| 9,647,369 | B2 * | 5/2017 | Tsai | H01R 4/02 |
| 9,755,336 | B2 * | 9/2017 | Cheng | H01R 12/712 |
| 9,812,818 | B2 * | 11/2017 | Tsai | H01R 13/6596 |
| 9,812,826 | B2 * | 11/2017 | Yu | H01R 24/64 |
| 9,837,769 | B2 * | 12/2017 | Yu | H01R 13/652 |
| 9,843,148 | B2 * | 12/2017 | Little | H01R 24/60 |

(Continued)

FOREIGN PATENT DOCUMENTS

| | | |
|---|---|---|
| CN | 202678584 | 1/2013 |
| CN | 204118317 | 1/2015 |

(Continued)

*Primary Examiner* — Alexander Gilman

(74) *Attorney, Agent, or Firm* — Wei Te Chung; Ming Chieh Chang

(57) ABSTRACT

An electrical connector includes: an insulative housing including a base portion and a tongue portion; and an upper and lower rows of conductive terminals retained to the insulative housing, each row of conductive terminals including a pair of grounding terminals at two ends thereof, each conductive terminal having a contacting section exposed to a surface of the tongue portion, a tail section extending out of the base portion, and a retaining section between the contacting section and the tail section; wherein each grounding terminal has a latch extending sidewardly to expose to a side of the tongue portion.

18 Claims, 10 Drawing Sheets

(56) References Cited

U.S. PATENT DOCUMENTS

| | | | | |
|---|---|---|---|---|
| 2015/0244111 | A1* | 8/2015 | Ju | H01R 13/6585 439/607.05 |
| 2016/0093994 | A1 | 3/2016 | Chen et al. | |
| 2016/0099526 | A1* | 4/2016 | Chen | H01R 13/5045 439/607.05 |
| 2016/0294102 | A1* | 10/2016 | Zhao | H01R 13/6581 |

FOREIGN PATENT DOCUMENTS

| | | | |
|---|---|---|---|
| CN | 204243365 | | 4/2015 |
| CN | 204315771 | U | 5/2015 |
| CN | 204391414 | | 6/2015 |
| CN | 104810657 | A | 7/2015 |
| CN | 104882696 | | 9/2015 |
| CN | 204696302 | U | 10/2015 |
| CN | 105024197 | A | 11/2015 |
| CN | 204793279 | | 11/2015 |
| CN | 204966754 | U | 1/2016 |

* cited by examiner

ELECTRICAL CONNECTOR HAVING GROUNDING TERMINALS SERVING A LATCHING FUNCTION

BACKGROUND OF THE INVENTION

1. Field of the Invention

The present invention relates to a dual orientation electrical connector including outermost grounding terminals having integrated side latch. The invention is related to a copending application having the same applicant, the same inventors and the same filing date with a title of ELECTRICAL CONNECTOR.

2. Description of Related Arts

China Patent No. 105024197, issued on Nov. 4, 2015, discloses an electrical connector including an insulative housing, an upper and lower rows of terminals, and a shell assembled to the insulative housing. The lower row of terminals include outermost grounding terminals and power terminals. A contacting section of each power terminal is so formed by tearing the material to have a side section at a front thereof in order to widen the contacting section for large current conduction. Each grounding terminal has an integral side latch so as to do without a middle shielding plate otherwise provided between the two rows of terminals.

SUMMARY OF THE INVENTION

An electrical connector comprises: an insulative housing including a base portion and a tongue portion; and an upper and lower rows of conductive terminals retained to the insulative housing, each row of conductive terminals including a pair of grounding terminals at two ends thereof, each conductive terminal having a contacting section exposed to a surface of the tongue portion, a tail section extending out of the base portion, and a retaining section between the contacting section and the tail section; wherein each grounding terminal has a latch extending sidewardly to expose to a side of the tongue portion.

DETAILED DESCRIPTION OF THE PREFERRED EMBODIMENT

Figure 1:
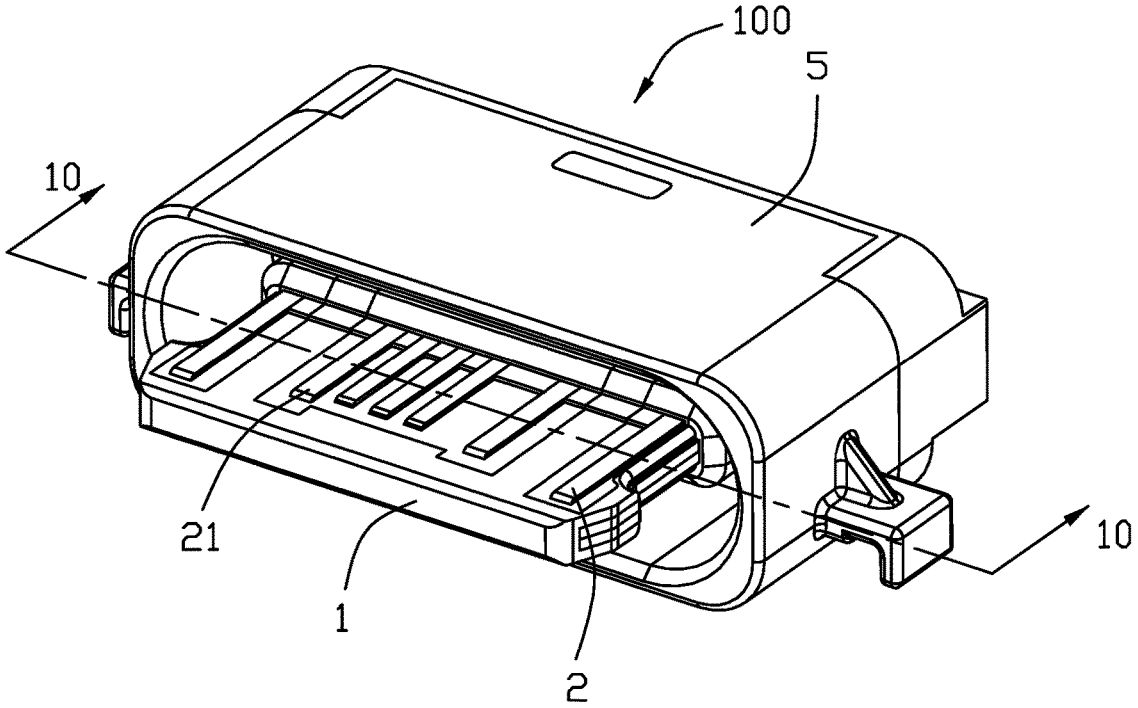
FIG. 1 is a perspective view of an electrical connector in accordance with the present invention.
Figure 2:
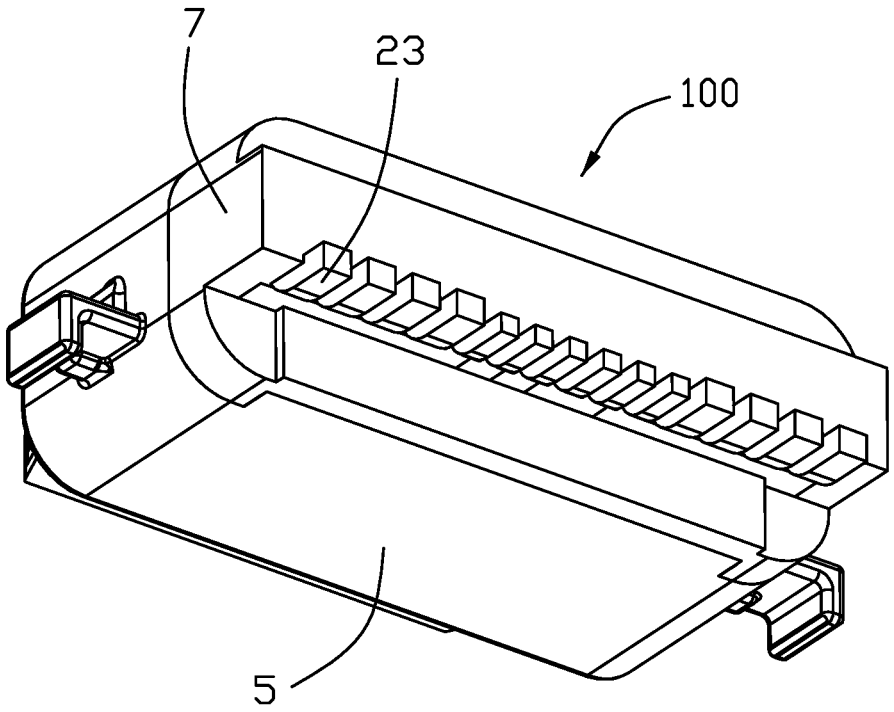
FIG. 2 is another perspective view of the electrical connector.
Figure 3:
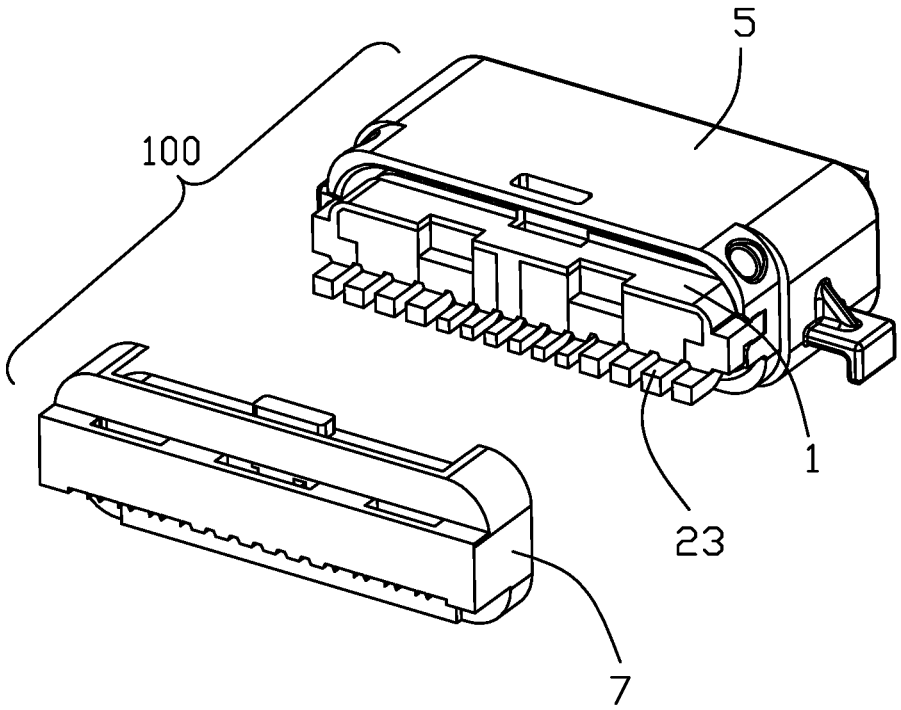
FIG. 3 is a partial exploded view of the electrical connector.
Figure 4:
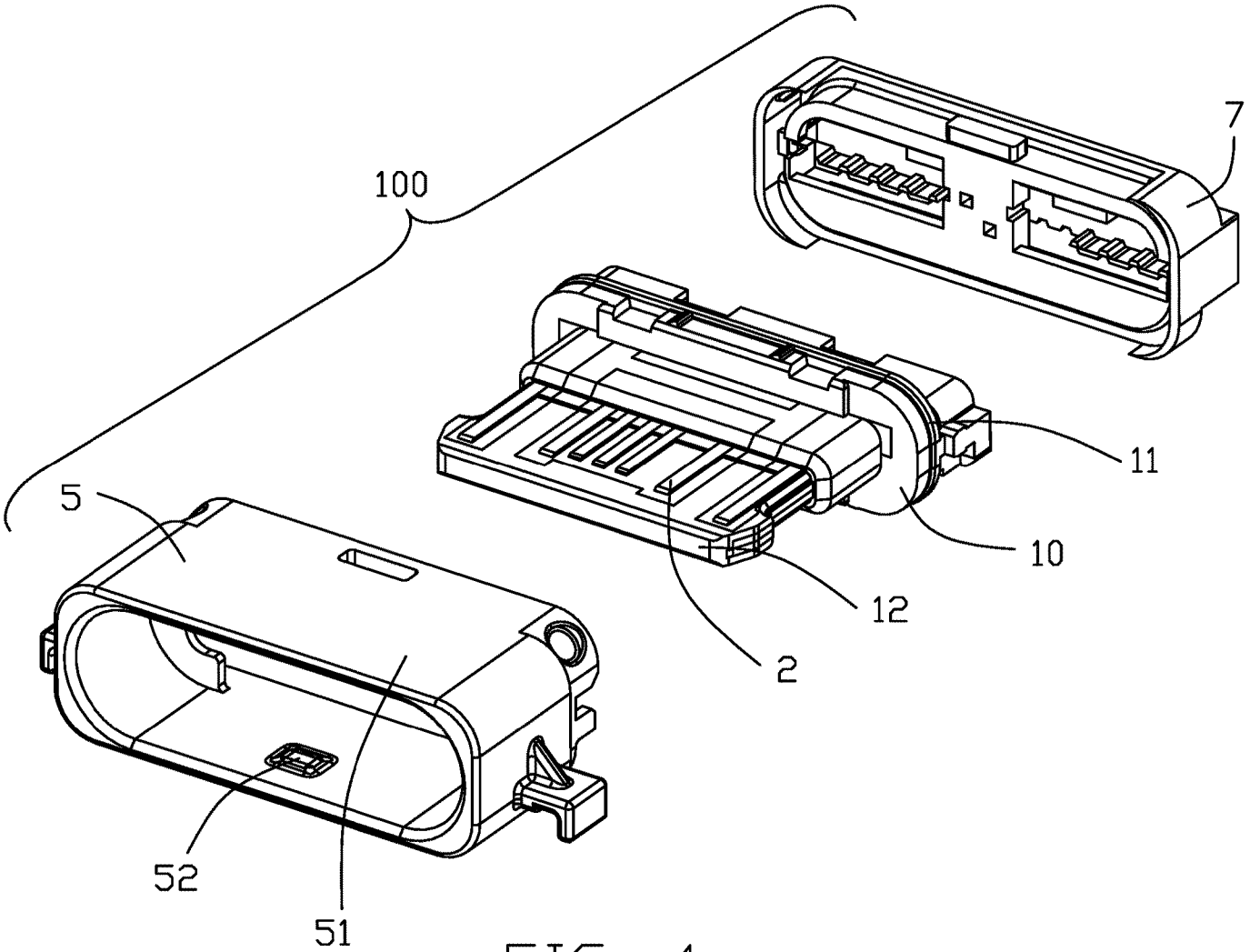
FIG. 4 is a further exploded view of the electrical connector.
Figure 5:
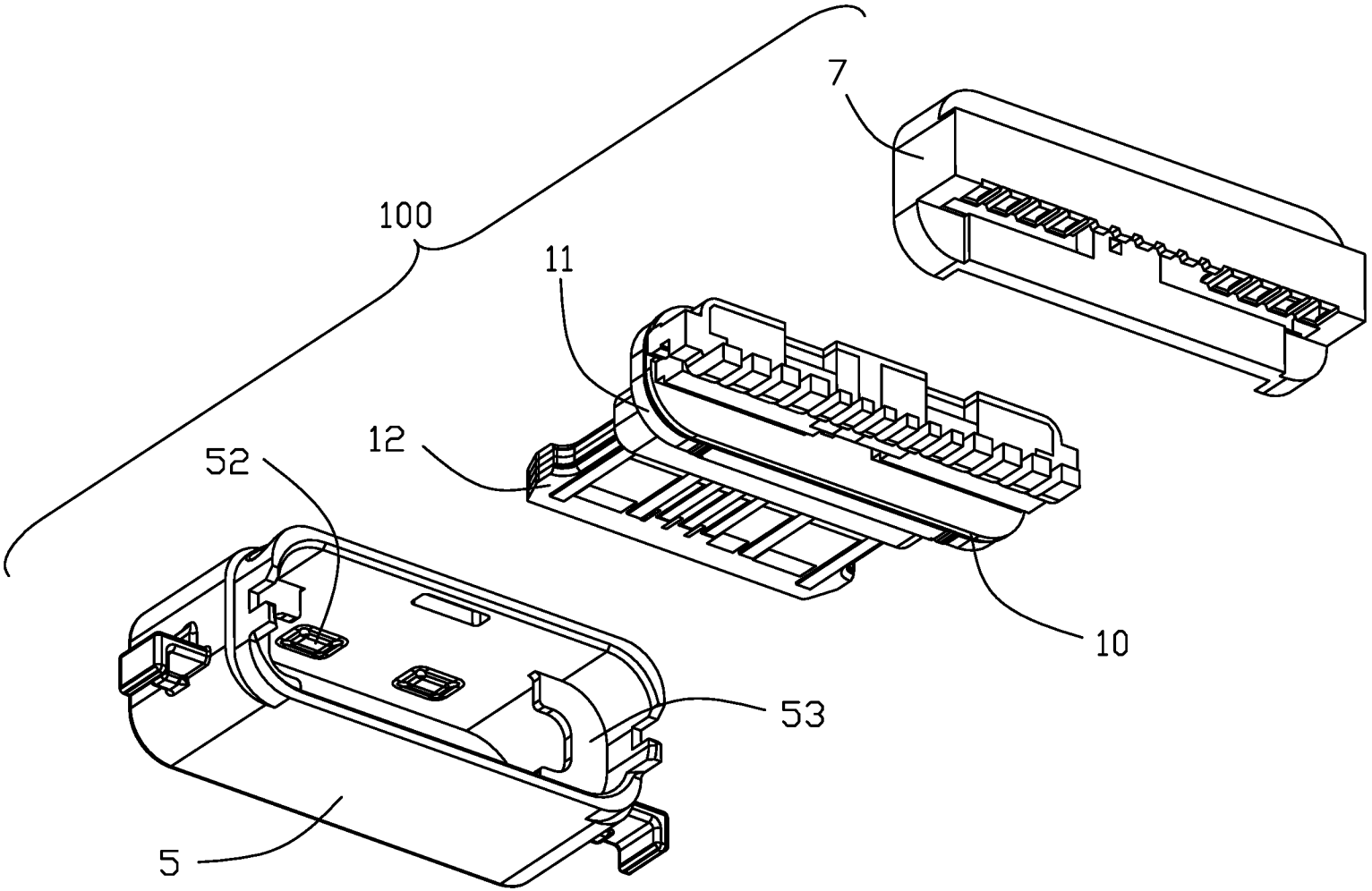
FIG. 5 is a view of the electrical connector in FIG. 4 from another perspective.
Figure 6:
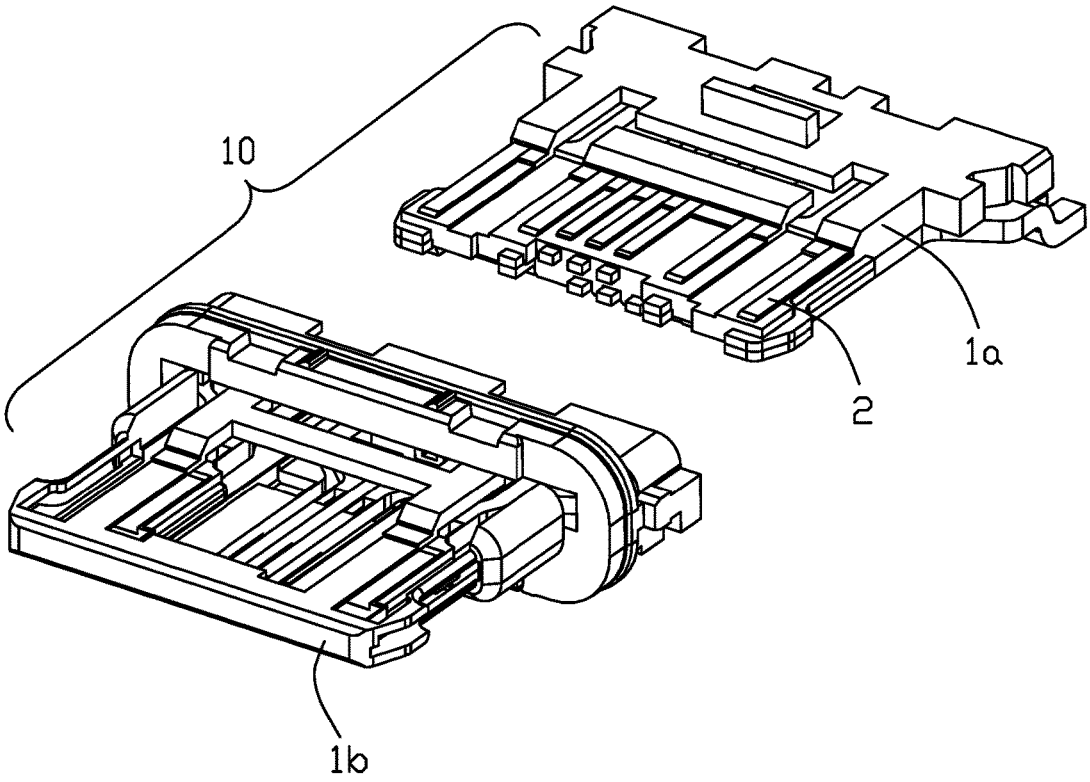
FIG. 6 is a partial exploded view of a contact module of the electrical connector.
Figure 7:
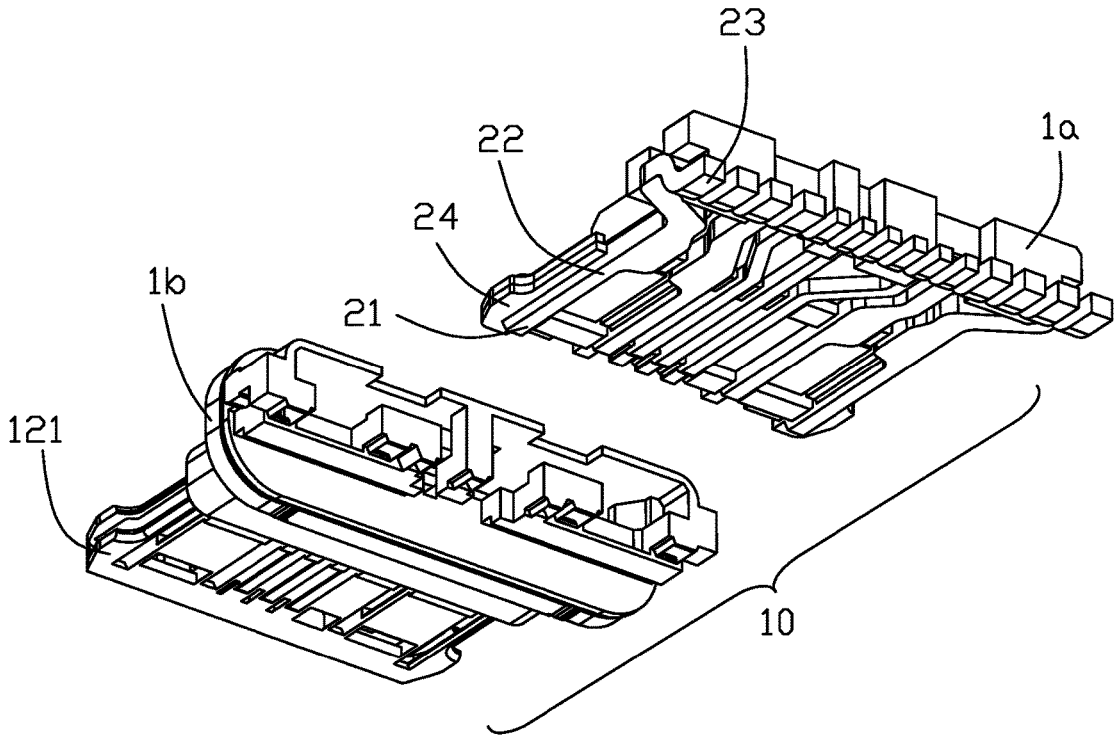
FIG. 7 is a view of the contact module in FIG. 6 from another perspective.

Referring to FIGS. 1 to 10, an electrical connector 100 includes an insulative housing 1 having a base portion 11 and a front tongue portion 12 and an upper and lower rows of conductive terminals 2 retained to the insulative housing 1. In this embodiment, the insulative housing 1 and the upper and lower rows of conductive terminals 2 are constructed as a contact module 10. The electrical connector 100 may further include a metal shell 5 enclosing the contact module 10 and a sealer 7 formed of glues sealing at a rear thereof.

The tongue portion 12 extends forwardly from the base portion 11, and the conductive terminals 2 are arranged in reverse symmetry in two rows.

Figure 8:
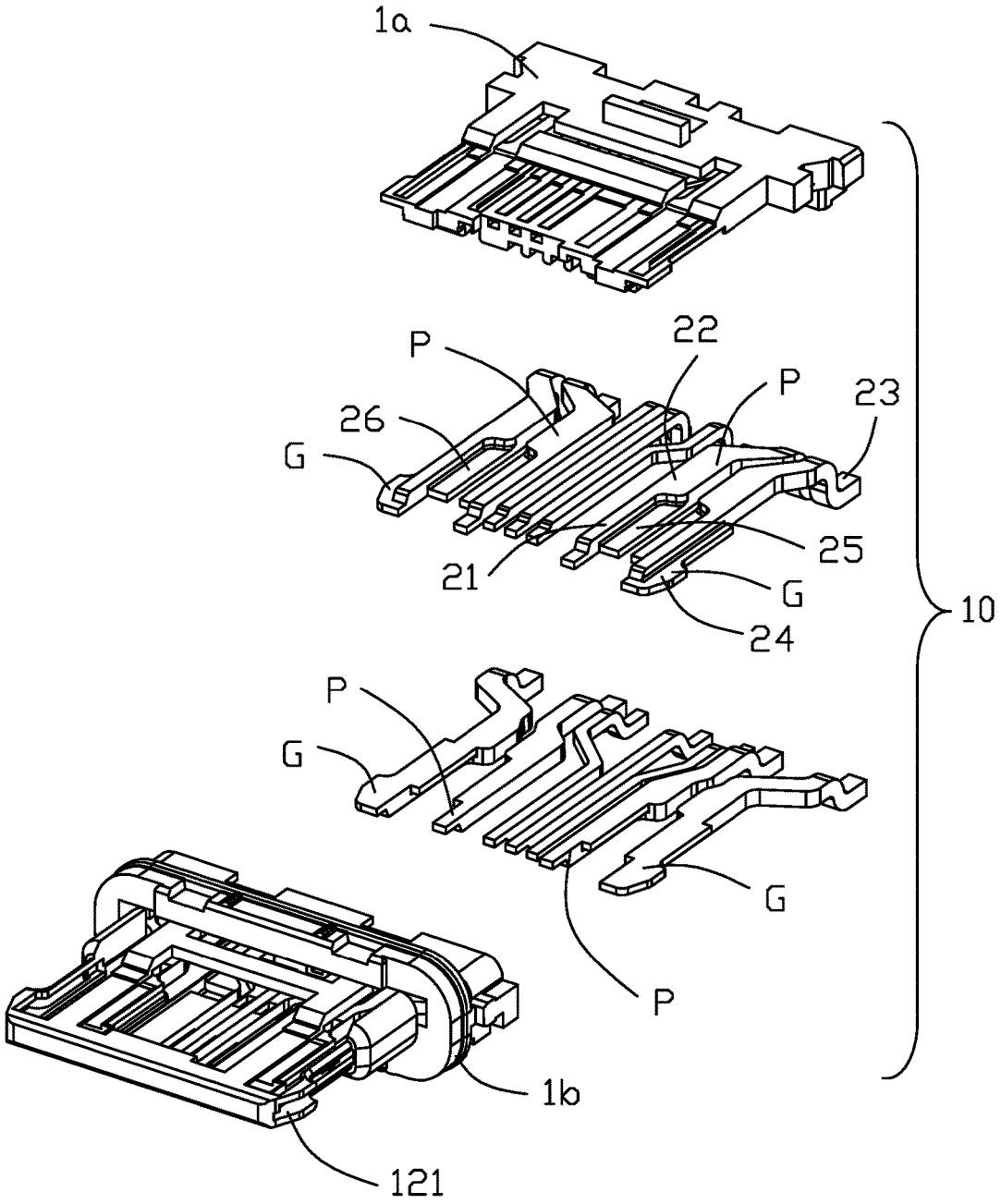
FIG. 8 is a further exploded view of the contact module in FIG. 6.
Figure 9:
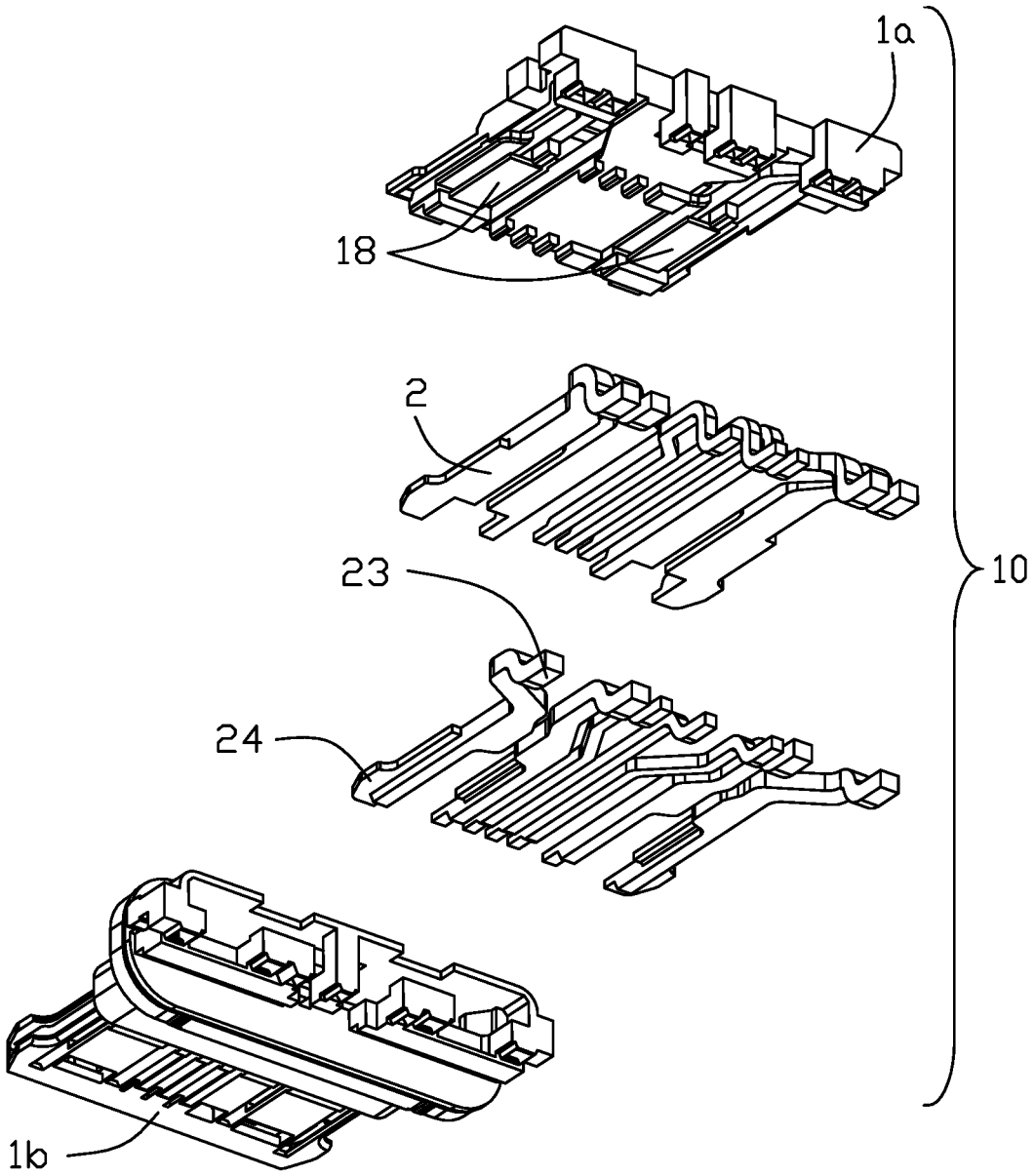
FIG. 9 is a view of the contact module in FIG. 8 from another perspective.
Figure 10:
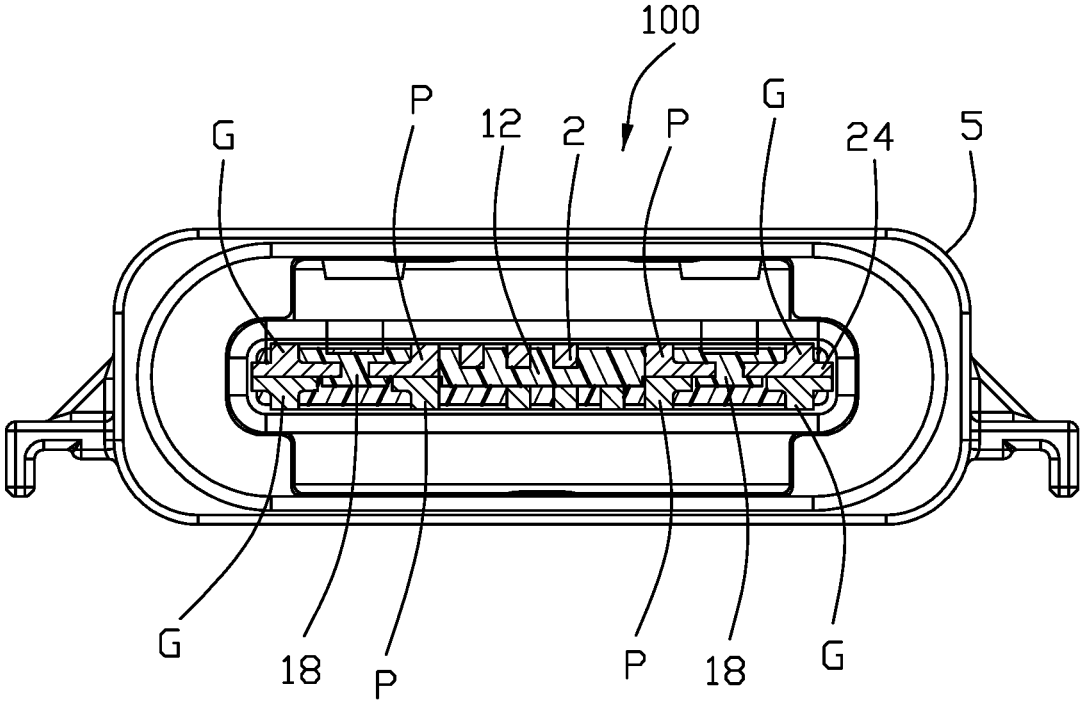
FIG. 10 is a cross-sectional view of the electrical connector taken along line A-A in FIG. 1.

In construction, the insulative housing 1 includes a first/inner insulator 1*a* over-molding a second/outer insulator 1*b*. The base portion 11 is formed by a rear end of the first insulator 1*a* and a rear end of the second insulator 1*b*. The tongue portion 12 is formed by a front end of the first insulator 1*a* and a front end of the second insulator 1*b*. The second insulator 1*b* includes a pair of protruding portions 121 (FIG. 8).

The conductive terminals 2 include two outermost grounding terminals G, a number of power terminals P, and a number of signal terminals S. Each terminal 2 includes a contacting portion 21 exposed to a surface of the tongue portion 12, a soldering portion 23 for soldering to a printed circuit board, and a connecting portion 22 between the contacting portion 21 and the soldering portion 23. Each grounding terminal G includes a latch 24 for latching with an inserted mating connector, and a widening portion 26 thinner than other parts thereof. The latch 24 extends forwardly beyond the contacting portion 21 and extends rearwardly to the connecting portion 22. The widening portion 26 is embedded in the tongue portion 12 and extends inward from the contacting portion 21. Each power terminal P includes a widening portion 25 extending laterally from the contacting portion 21.

The metal shell 5 includes a main portion 51 of generally annular shape, and a grounding portion 52 protruding inward from the main portion 51.

A method of making the electrical connector 100 includes the following steps. In a first step, the two rows of conductive terminals 2 are stamped from a metal sheet to include the grounding terminals G. The latch 24 and the widening portion 26 are formed by thinning a front portion of the grounding terminal G, and the remaining portion forms the contacting portion 21 thereof. The widening portion 25 is formed by thinning a front portion of the power terminal P, and the remaining portion forms the contacting portion 21 thereof.

Then, the upper terminals are insert molded with the first insulator 1*a*. The lower terminals abut the insert molded first insulator 1*a* and upper terminals in such a way that the grounding terminals G of the upper terminals 2 and the grounding terminal G of the lower terminals 2 are stacked in a vertical direction. The insulative housing 1 is then completed by over-molding the first insulator 1*a* with the lower terminals and the insert-molded second insulator 1*b* and upper terminals. The protruding portions 121 are insert molding with the latches 24 to be an integrated design for mating with the mated electrical connector. The bottom surface of the contacting portion 21 of the grounding terminal G is coplanar with the bottom surface of the latch 24. The latch 24 of the grounding terminal G is embedded in the tongue portion 12, thus making the top surface of the latch 24 be lower than the top surface of the contacting portion 21. The thickness of the contacting portion 21 of the power terminal P is equal to that of the contacting portion 21 of the grounding terminal G. The thickness of the contacting portion 21 of the power terminal P is greater than that of the contacting portion 21 of the signal terminal. The sum of the thickness of the grounding terminal of the upper terminal 2 and the grounding terminal of the lower terminal 2 is not less than that of the tongue portion 12. The inner insulator 1*a* forms a pair of retaining structures 18 with an I-shaped cross-section to hold and separate the corresponding power terminal P and grounding terminal G in the upper row while leaving enough space on two sides to allow the power terminal P in the lower row to intimately contact the power terminal P in the upper row, and the grounding terminal G in the lower row to intimately contact the grounding terminal G in the upper row. It is also noted that the paired/stacked power terminals P in both the upper and lower rows, and the paired/stacked grounding terminals G in both the upper and lower rows have the similar thickness of the tongue portion for being exposed upon the mating surfaces of the tongue portion while the stacked widened portion 26 of the stacked power terminals P, and the stacked latch 24 of the stacked grounding terminals P are thinned for not being exposed upon the opposite mating surfaces of the tongue portion.

Afterwards, the contact module 10 is assembled in a rear-to-front direction to the metal shell 5 that is formed by metal injection molding.

The sealer 7 is finally formed at a gap between the rear end of the insulative housing 1 and the metal shell 5.

Provision of the latch and widening portion on the grounding terminal replaces a middle shielding plate and increases a cross sectional area thereof. This also makes it feasible to design the power terminal with a desired thickness for large current conduction.

What is claimed is:

1. An electrical connector comprising:

an insulative housing including a base portion and a tongue portion; and an upper and lower rows of conductive terminals retained to the insulative housing, each row of conductive terminals including a pair of grounding terminals at two ends thereof, each conductive terminal having a contacting section exposed to a surface of the tongue portion, a tail section extending out of the base portion, and a retaining section between the contacting section and the tail section; wherein each grounding terminal has a latch extending sidewardly to expose to a side of the tongue portion; and a bottom surface of the contacting section and a bottom surface of the latch of each grounding terminal are coplanar.

2. The electrical connector as claimed in claim 1, wherein the upper pair of grounding terminals are aligned with the lower pair of grounding terminals, and the latch of each of the upper pair of grounding terminals contacts the latch of a corresponding lower grounding terminal.

3. The electrical connector as claimed in claim 1, wherein the latch is formed by thinning the conductive terminal.

4. The electrical connector as claimed in claim 1, wherein the latch extends from the retaining section beyond the contacting section.

5. The electrical connector as claimed in claim 1, wherein each row of conductive terminals include a pair of power terminals located inwardly adjacent to associated grounding terminals, the power terminal having a widened section embedded in the tongue portion.

6. The electrical connector as claimed in claim 1, wherein each row of conductive terminals include a pair of power terminals located inwardly adjacent to associated grounding terminals, each upper power terminal being in contact with a corresponding lower power terminal.

7. An electrical connector comprising:

an insulative housing including a base portion and a tongue portion forwardly extending from the base portion along a front-to-back direction, the tongue portion defining opposite mating surfaces in a vertical direction perpendicular to the front-to-back direction; and upper and lower rows of conductive terminals retained to the insulative housing and spaced from each other in said vertical direction, each row of conductive terminals arranged in a transverse direction perpendicular to both said front-to-back direction and said vertical direction, and including a pair of grounding terminals at two ends thereof in said transverse direction, a pair of power terminals located between said pair of grounding terminals in said transverse direction, and a plurality of signal terminals between the pair of power terminals in said transverse direction, each conductive terminal having a contacting section exposed to the corresponding mating surface of the tongue portion, a tail section extending out of the base portion, and a retaining section between the contacting section and the tail section; wherein a bottom surface of the contacting section of each grounding terminal is flat; and the power terminals in the upper row and the corresponding power terminals in lower row are stacked with each other in the vertical direction, the flat bottom surfaces of the contacting sections of the grounding terminals in the upper row and the corresponding grounding terminals in the lower row are stacked with each other in the vertical direction while the signal terminals in the upper row and the corresponding signal terminals in the lower row are spaced from each other in the vertical direction by the housing.

8. The electrical connector as claimed in claim 7, wherein said one row of the upper row and the lower row of terminals are firstly integrally formed within an inner insulator, and the other row of the upper row and the lower row of terminals are successively positioned upon the inner insulator and molded with an outer insulator to commonly form a contact module.

9. The electrical connector as claimed in claim 8, wherein said inner insulator includes a retaining structure to hold and separate both the corresponding power terminal and grounding terminal in the upper row.

10. The electrical connector as claimed in claim 9, wherein said retaining structure is of an I-shaped cross-section in a front view.

11. The electrical connector as claimed in claim 7, wherein the stacked power terminal in the upper row and that in the lower row have a total thickness similar to that of the tongue portion, and the stacked grounding terminal in the upper row and that in the lower row have a total thickness similar to that of the tongue portion.

12. The electrical connector as claimed in claim 11, wherein each power terminal further includes a widened portion, and the widened portion of the power terminal in the upper row and that in the lower row have a total thickness less than that of the tongue portion for being not exposed upon the corresponding mating surface of the tongue portion.

13. The electrical connector as claimed in claim 11, wherein each grounding terminal further includes a lateral projecting latch, and the latch of the grounding terminal in the upper row and that in the lower row have a total thickness less than that of the tongue portion for being not exposed upon the corresponding mating surface of the tongue portion.

14. An electrical connector comprising:

an insulative housing including a base portion and a tongue portion forwardly extending from the base portion along a front-to-back direction, the tongue portion defining opposite mating surfaces in a vertical direction perpendicular to the front-to-back direction; and upper and lower rows of conductive terminals retained to the insulative housing and spaced from each other in said vertical direction, each row of conductive terminals arranged in a transverse direction perpendicular to both said front-to-back direction and said vertical direction, and including a pair of grounding terminals at two ends thereof in said transverse direction, a pair of power terminals located between said pair of grounding terminals in said transverse direction, and a plurality of signal terminals between the pair of power terminals in said transverse direction, each conductive terminal having a contacting section exposed to the corresponding mating surface of the tongue portion, a tail section extending out of the base portion, and a retaining section between the contacting section and the tail section; wherein the grounding terminals in the upper row and the corresponding grounding terminals in the lower row are stacked/paired with each other in the vertical direction while the signal terminals in the upper row and the corresponding signal terminals in the lower row are space from each other in the vertical direction by the housing; wherein in each grounding terminal, a cross-section of the contacting section viewed along the front-to-back direction includes a thick region and a thinned region wherein the thick regions of the paired grounding terminals have a total thickness similar to that of the tongue portion for being exposed upon the corresponding mating surfaces while the thinned regions of the paired grounding terminals have a total thickness less than that of the tongue portion for not being exposed upon the corresponding mating surfaces.

15. The electrical connector as claimed in claim 14, wherein the power terminals in the upper row and the corresponding power terminals in the lower row are stacked/paired with each other in the vertical direction, in each power terminal a cross-section of the contacting section viewed along the front-to-back direction includes a thick region and a thinned region wherein the thick regions of the paired power terminals have a total thickness similar to that of the tongue portion for being exposed upon the corresponding mating surfaces while the thinned regions of the paired power terminals have a total thickness less than that of the tongue portion for not being exposed upon the corresponding mating surfaces.

16. The electrical connector as claimed in claim 15, wherein said inner insulator includes a retaining structure to hold and separate both the corresponding power terminal and grounding terminal in the upper row.

17. The electrical connector as claimed in claim 16, wherein said retaining structure is of an I-shaped cross-section in a front view.

18. The electrical connector as claimed in claim 14, wherein a bottom surface of the contacting section of each grounding terminal is flat.

* * * * *